US009860631B2

(12) United States Patent
Hernandez Garcia et al.

(10) Patent No.: US 9,860,631 B2
(45) Date of Patent: Jan. 2, 2018

(54) SOUND RECORDING MODULE

(71) Applicant: Merry Electronics(Shenzhen) Co., Ltd., Guangdong (CN)

(72) Inventors: Diego Jose Hernandez Garcia, Taichung (TW); Ming-Yo Hung, Taichung (TW); Wen-Hong Wang, Taichung (TW)

(73) Assignee: Merry Electronics (Shenzhen) Co., Ltd., Guangdong (CN)

( * ) Notice: Subject to any disclaimer, the term of this patent is extended or adjusted under 35 U.S.C. 154(b) by 0 days.

(21) Appl. No.: 15/139,347

(22) Filed: Apr. 27, 2016

(65) Prior Publication Data

US 2017/0223446 A1 Aug. 3, 2017

(30) Foreign Application Priority Data

Feb. 2, 2016 (TW) ..... 105103346 A

(51) Int. Cl.
*H04R 1/34* (2006.01)

(52) U.S. Cl.
CPC ..... *H04R 1/342* (2013.01); *H04R 2499/11* (2013.01)

(58) Field of Classification Search
CPC ..... H04R 1/2807; H04R 1/28; H04R 1/1075; H04R 1/04; H04R 1/34; G11B 20/10527; G11B 2020/10546
See application file for complete search history.

(56) References Cited

U.S. PATENT DOCUMENTS

| | | | | |
|---|---|---|---|---|
| 4,308,426 | A | 12/1981 | Kikuchi | |
| 2005/0157901 | A1* | 7/2005 | Hatano | H04R 1/34 381/356 |
| 2008/0212804 | A1* | 9/2008 | Watanabe | H04R 1/04 381/120 |

FOREIGN PATENT DOCUMENTS

| | | |
|---|---|---|
| CN | 202759558 | 2/2013 |
| TW | 381013 | 2/2000 |

* cited by examiner

*Primary Examiner* — Fan Tsang
*Assistant Examiner* — Angelica M McKinney
(74) *Attorney, Agent, or Firm* — JCIPRNET

(57) ABSTRACT

A sound recording module including a sound-collecting space, a sound wave inlet, and a sound-receiving element is provided. The sound-collecting space at least has a reflecting zone. The reflecting area is adjacent to a first sound wave gathering zone and a second sound gathering zone, respectively. The first sound wave gathering zone appears in form of a hand web and defines a sound-receiving element fixing portion in the deepest position of the first sound gathering zone. The sound wave inlet is correspondingly formed on at least part of a periphery of the second sound gathering zone. The sound-receiving element is disposed at the sound-receiving element fixing portion of the first sound gathering zone. The sound-receiving element is configured to record a sound entering the sound-collecting space.

8 Claims, 5 Drawing Sheets

100

100

100A

100A

100B

100B

100C

100C

SOUND RECORDING MODULE

CROSS-REFERENCE TO RELATED APPLICATION

This application claims the priority benefit of Taiwan application serial no. 105103346, filed on Feb. 2, 2016. The entirety of the above-mentioned patent application is hereby incorporated by reference herein and made a part of this specification.

BACKGROUND OF THE INVENTION

1. Field of the Invention

The invention generally relates to a sound recording module, and more particularly to, a sound recording module with favorable sound-collecting effect.

2. Description of Related Art

Current commercially available speakers are mostly unable to exhibit a natural sound field, and a reason thereof lies in that: sound waves broadcasted from the speakers are firstly passing through the air and then transmitted to a human ear, next, sequentially passing through an auricle and an external ear canal to be transmitted to an eardrum, and finally be sensed by brain nerves. In the aforesaid sound wave transmission process, the sound waves would be subjected to a phenomenon, such as refraction or diffraction, due to influences from the human auricle, the human external ear canal, the human skull or the human shoulder, thereby affecting the sound quality.

A conventional practice adopts a binaural recording method with the use of "a dummy head" to improve the aforementioned drawbacks, and this recording method places two miniature omnidirectional microphones in external ear canals of the dummy head (e.g., at positions near the eardrums of the human ears). A sound wave to be recorded is transmitted to the miniature omnidirectional microphones after passing through dummy auricles and dummy external ear canals, and the sound wave to be recorded would also be subjected to the influences of the auricles, the dummy external ear canals, the skull or the shoulder, namely, realistically simulates an influence of head-related transfer function (HRTF) on the human ears when the human ears hear a sound. As such, the recorded sound, when being played, can almost reproduce an effect of stereo sound. However, a user must carry along the dummy head to timely record sounds so as to reproduce the sounds that are almost being heard by the human ears, and thus it is very inconvenient in operation.

SUMMARY OF THE INVENTION

The invention provides a sound recording module with favorable sound-collecting effect.

The invention provides a sound recording module, which includes a sound-collecting space, a sound wave inlet and a sound-receiving element. The sound-collecting space at least has a reflecting zone. The reflecting zone is adjacent to a first sound wave gathering zone and a second sound wave gathering zone, respectively. The first sound wave gathering zone appears in form of a hand web and defines a sound-receiving element fixing portion at the deepest position thereof. The sound wave inlet is correspondingly formed on at least part of a periphery of the second sound wave gathering zone. The sound-receiving element is disposed at the sound-receiving element fixing portion of the first sound wave gathering zone. The sound-receiving element is configured to record a sound entering the sound-collecting space.

In one embodiment of the invention, the sound recording module further includes a sound-collecting structure. The sound-collecting structure has a through hole, wherein the through hole passes through the sound-receiving element fixing portion of the first sound wave gathering zone, and the sound wave inlet and the through hole are respectively located at two opposite sides of the sound-collecting space.

In one embodiment of the invention, the sound recording module further includes a case. The sound-collecting structure is disposed within the case, and the sound-collecting structure and the case define the sound-collecting space and the sound wave inlet.

In one embodiment of the invention, the sound-collecting structure and the case further define a sound wave entering zone. The sound wave entering zone is adjacent to the second sound wave gathering zone, and the reflecting zone is located between the sound wave entering zone and the second sound wave gathering zone.

In one embodiment of the invention, the first sound wave gathering zone and the sound-receiving element are respectively located at two opposite sides of the sound-collecting structure, and the through hole exposes at least a portion of the sound-receiving element.

The invention provides another sound recording module, which includes a first sound-collecting space, a second sound-collecting space, a first sound wave inlet, a second sound wave inlet, a first sound-receiving element and a second sound-receiving element. The first sound-collecting space at least has a first, reflecting zone. The first reflecting zone is adjacent to a first sound wave gathering zone and a second sound wave gathering zone, respectively. The first sound wave gathering zone appears in form of a hand web and defines a first sound-receiving element fixing portion at the deepest position thereof. The second sound-collecting space and the first sound-collecting space are juxtaposed. The second sound-collecting space at least has a second reflecting zone. The second reflecting zone is adjacent to a third sound wave gathering zone and a fourth sound wave gathering zone, respectively. The third sound wave gathering zone appears in form of a hand web and defines a second sound-receiving element fixing portion at the deepest position thereof, and the first sound-receiving element fixing portion and the second sound-receiving element fixing portion are opposite to each other. The first sound wave inlet is correspondingly formed on at least part of a periphery of the second sound wave gathering zone. The second sound wave inlet is correspondingly formed on at least part of a periphery of the fourth sound wave gathering zone, and the first sound wave inlet and the second sound wave inlet are opposite to each other. The first sound-receiving element is disposed at the first sound-receiving element fixing portion of the first sound wave gathering zone, and the first sound-receiving element is configured to record a sound entering the first sound-collecting space. The second sound-receiving element is disposed at the second sound-receiving element fixing portion of the third sound wave gathering zone, and the second sound-receiving element is configured to record a sound entering the second sound-collecting space.

In one embodiment of the invention, the sound recording module further includes a sound-collecting structure. The sound-collecting structure has a first through hole and a second through hole opposite to the first through hole. The first through hole passes through the first sound-receiving element fixing portion of the first sound wave gathering zone, and the first sound wave inlet and the first through hole are respectively located at two opposite sides of the first sound-collecting space. The second through hole passes through the second sound-receiving element fixing portion of the third sound wave gathering zone, and the second sound wave inlet and the second through hole are respectively located at two opposite sides of the second sound-collecting space.

In one embodiment of the invention, the sound recording module further includes a case. The sound-collecting structure is disposed within the case, and the sound-collecting structure and the case define the first sound-collecting space, the first sound wave inlet, the second sound-collecting space and the second sound wave inlet.

In one embodiment of the invention, the sound-collecting structure and the case further define a first sound wave entering zone and a second sound wave entering zone. The first sound wave entering zone is adjacent to the second sound wave gathering zone, and the first reflecting zone is located between the first sound wave entering zone and the second sound wave gathering zone. The second sound wave entering zone is adjacent to the fourth sound wave gathering zone, and the second reflecting zone is located between the second sound wave entering zone and the fourth sound wave gathering zone.

In one embodiment of the invention, the first sound wave gathering zone and the first sound-receiving element are respectively located at two opposites sides of the sound-collecting structure, and the first through hole exposes at least a portion of the first sound-receiving element. The third sound wave gathering zone and the second sound-receiving element are respectively located at the two opposites sides of the sound-collecting structure, and the second through hole exposes at least a portion of the second sound-receiving element.

In view of the above, as differences in sound wave transmission distance will result in sound pressure and phase differences, through utilizing a design of gradually reducing an aperture of the sound-collecting space from the sound wave inlet towards the deepest position (or referred as the sound-receiving element fixing portion) thereof and the design of the reflecting zone, interference of a sound wave entering the sound-collecting space can be controlled, thereby achieving favorable horizontal directivity and noise elimination. As a result, the sound recorded by the sound recording module of the invention, when being played, not only can reproduce an effect of stereo sound but also can provide favorable sound quality.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
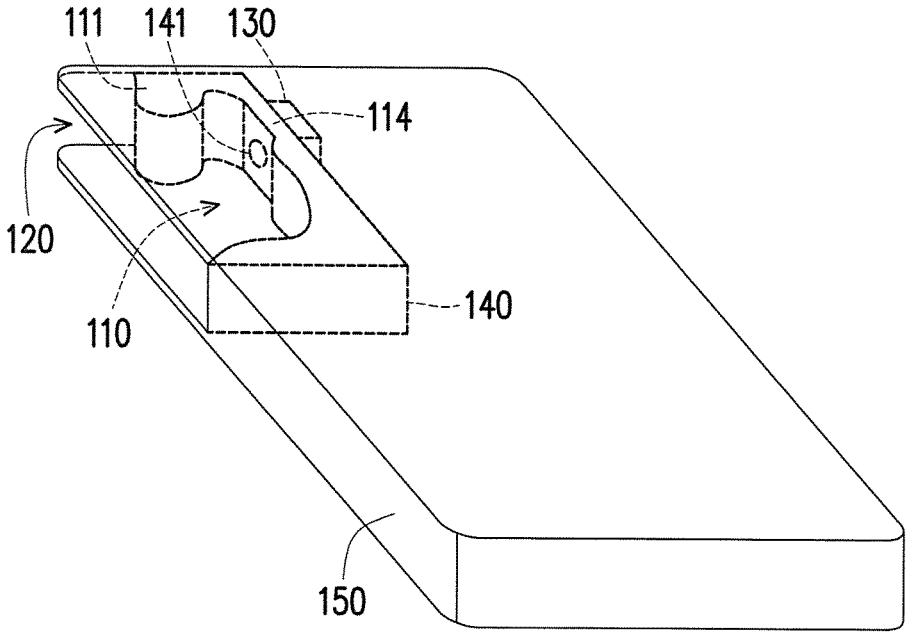
FIG. 1A is a schematic diagram illustrating a sound recording module according to a first embodiment of the invention.
Figure 1B:
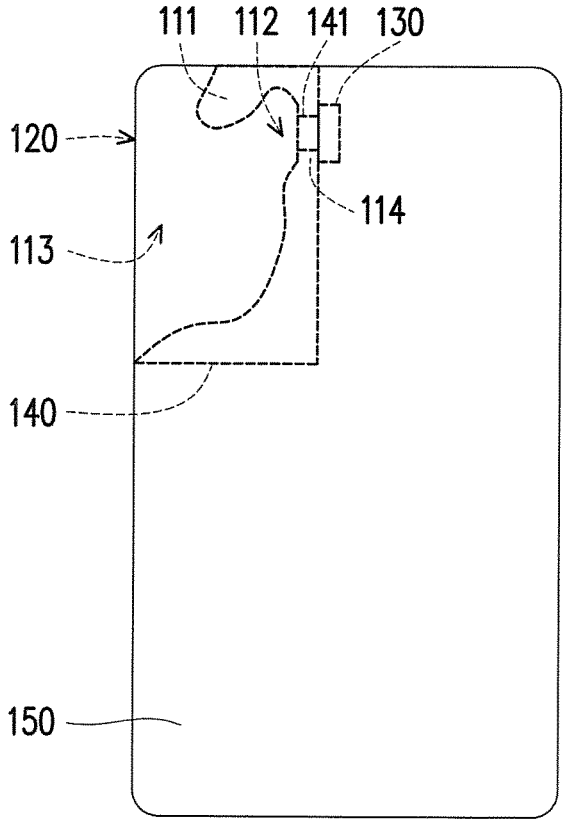
FIG. 1B is a schematic top view illustrating the sound recording module of FIG. 1A.

FIG. 1A is a schematic diagram illustrating a sound recording module according to a first embodiment of the invention. FIG. 1B is a schematic top view illustrating the sound recording module of FIG. 1A. Referring to FIG. 1A and FIG. 1B, in the present embodiment, a sound recording module 100 includes a first sound-collecting space 110, a first sound wave inlet 120 and a first sound-receiving element 130. The first sound-collecting space 110 at least has a first reflecting zone 111. The first reflecting zone 111 is adjacent to a first sound wave gathering zone 112 and a second sound wave gathering zone 113, respectively. The first sound wave gathering zone 112 appears in form of a hand web and defines a first sound-receiving element fixing portion 114 at a deepest position thereof. The first sound wave inlet 120 is correspondingly formed on at least part of a periphery of the second sound wave gathering zone 113. The first sound-receiving element 130 is disposed at the first sound-receiving element fixing portion 114 of the first sound wave gathering zone 112. The first sound-receiving element 130 is configured to record a sound entering the first sound-collecting space 110.

In detail, the sound recording module 100 further includes a sound-collecting structure 140 and a case 150, the sound-collecting structure 140 is disposed within the case 150, and the first sound-collecting space 110 and the first sound wave inlet 120 are, for example, defined by the sound-collecting structure MO and the case 150. For instance, a periphery of the case 150 may have an opening, and the first sound wave inlet 120 which belongs to a portion of the opening can be defined through the sound-collecting structure 140. The first sound wave inlet 120 and the second sound wave gathering zone 113 are communicated with each other, wherein the second sound wave gathering zone 113 is located between the first sound wave inlet 120 and the first sound wave gathering zone 112, and the second sound wave gathering zone 113 and the first sound wave gathering zone 112 are communicated with each other. In addition, the second sound wave gathering zone 113 and the first sound wave gathering zone 112 are respectively located at two opposite sides of the first reflecting zone 111, and the first sound wave gathering zone 112 and the sound-receiving element 130 are respectively located at two opposite sides of the sound-collecting structure 140.

In the present embodiment, an aperture of the second sound wave gathering zone 113 gradually reduces from the first sound wave inlet 120 towards the first sound wave gathering zone 112, and an aperture of the first sound wave gathering zone 112 gradually reduces from the second sound wave gathering zone 113 towards the deepest position (or referred as the first sound-receiving element fixing portion 114). The deepest position is a place in the first sound wave gathering zone 112 farthest away from a connection between the first sound wave gathering zone 112 and the second sound wave gathering zone 113. As shown in FIG. 1B, the aperture in the first sound wave gathering zone 112 which is relatively close to the second sound wave gathering zone 113 is greater than the aperture which is relatively close to the deepest position (or referred as the first sound-receiving element fixing portion 114) in the first sound wave gathering zone 112, and thus the first sound wave gathering zone 112 appears in form of the hand web. On the other hand, the sound-collecting structure 140 has a first through hole 141, wherein the first through hole 141 passes through the first sound-receiving element fixing portion 114 of the first sound wave gathering zone 112, and the first sound wave inlet 120 and the first through hole 141 are respectively located at two opposite sides of the first sound-collecting space 110.

The first sound-receiving element 130 is, for example, a miniature omnidirectional microphone, which is disposed within the case 150 and located at a side of the sound-collecting structure 140. In detail, the first sound-receiving element 130 and the first sound wave gathering zone 112 are respectively located at two opposite sides of the first through hole 141. Therefore, at least a portion of the first sound-receiving element 130 fixed on the first sound-receiving element fixing portion 114 of the first sound wave gathering zone 112 can be exposed by the first through hole 141. In other embodiments, the first sound-receiving element 130 is disposed corresponding to the first through hole 141 but maintains a gap with the first sound-receiving element fixing portion 114 of the first sound wave gathering zone 112, or is disposed on the first sound-receiving element fixing portion 114 of the first sound wave gathering zone 112, and located within the first sound wave gathering zone 112. In general, the first sound-receiving element 130 is electrically connected to a circuit board (not shown) and electrically connected to a sound processing unit (not shown) through the circuit board (not shown), wherein the sound processing unit (not shown) is electrically connected to a sound storage unit (not shown) through the circuit board (not shown). As such, the sound recorded by the first sound-receiving element 130 can be transmitted to the sound processing unit (not shown) through the circuit board (not shown), and be transmitted to the sound storage unit (not shown) through the circuit board (not shown) so as to be stored after the sound is processed.

In view of the above, sound wave from the outside can enter the first sound-collecting space 110 from the first sound wave inlet 120, and transmission paths of the sound wave in the first sound-collecting space 110 can be summarized as follow: (1) under a condition of sequentially passing through the second sound wave gathering zone 113 and the first sound wave gathering zone 112 without contacting the sound-collecting structure 140, the sound wave that passed through the first sound wave gathering zone 112 passes through the first through hole 141 and is thus recorded by the first sound-receiving element 130; (2) the sound wave contacts the sound-collecting structure 140 when passing through the second sound wave gathering zone 113, then passes through the first through hole 141 after being reflected by the first reflecting zone 111, and is thus recorded by the first sound-receiving element 130; (3) the sound wave contacts the sound-collecting structure 140 when passing through the first sound wave gathering zone 112, then passes through the first through hole 141 after being reflected by the first reflecting zone 111, and is thus recorded by the first sound-receiving element 130. Because differences in transmission distance of the sound wave can result in sound pressure and phase differences, through utilizing the design of gradually reducing the aperture of the first sound-collecting space 110 from the first sound wave inlet 120 towards the deepest position (or referred as the first sound-receiving element fixing portion 114) thereof and the design of the first reflecting zone 111, interference of the sound wave entering the sound-collecting space 110 can thus be controlled, thereby achieving favorable horizontal directivity and noise elimination. As a result, the sound recorded by the sound recording module 100 of present embodiment, when being played, not only can reproduce an effect of stereo sound but also can provide favorable sound quality.

Figure 1C:
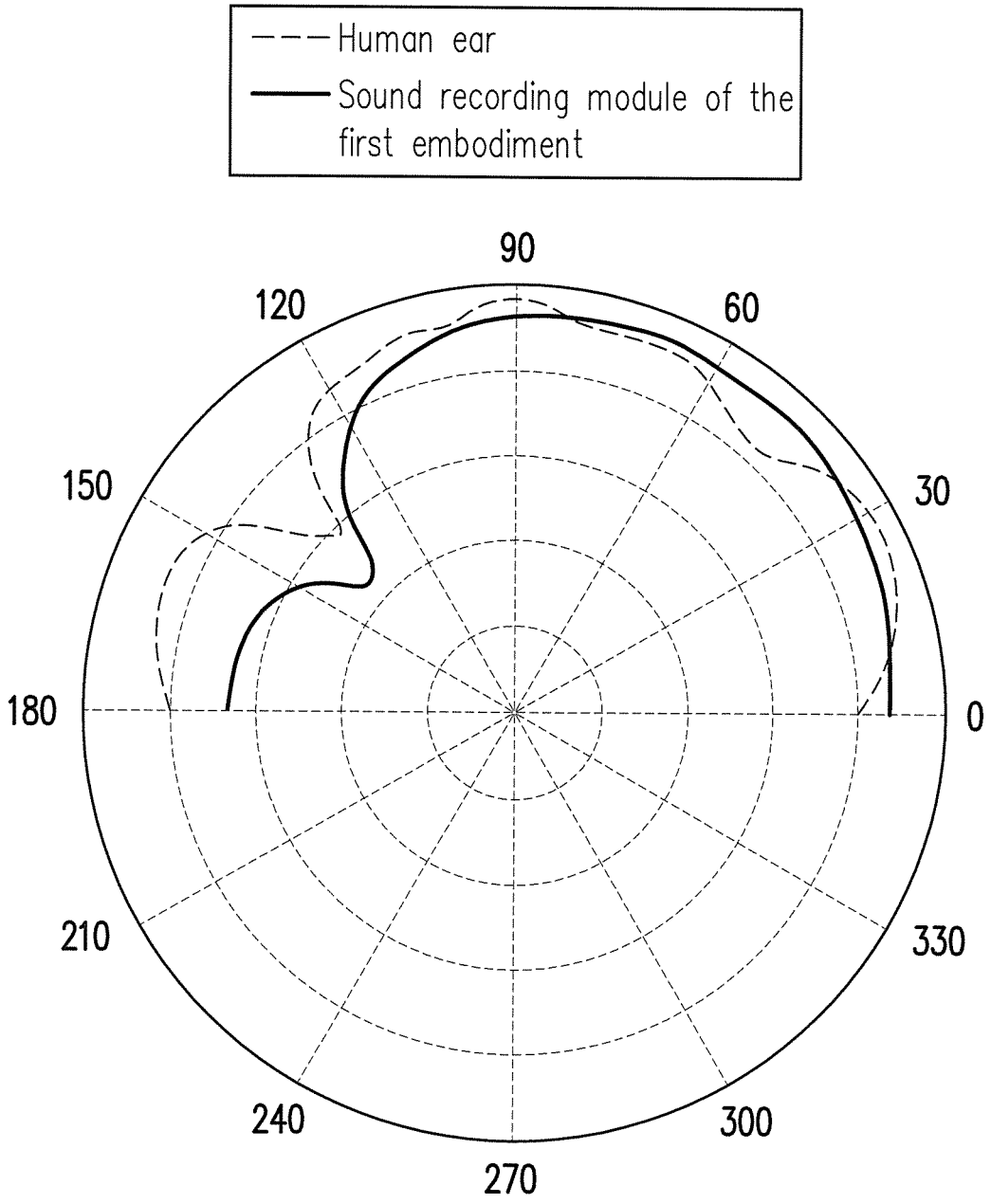
FIG. 1C is a polar plot which shows horizontal directivity test results of a human ear and the sound recording module of the first embodiment.

FIG. 1C is a polar plot which shows the horizontal directivity test results of a human ear and the sound recording module of the first embodiment. As shown in FIG. 1C, a sound wave frequency for the test is 4 kHz, and the test results show that the horizontal directivity of the sound recording module 100 is similar to the horizontal directivity of the human ear.

It is to be noted that, the case 150 of the sound recording module 100 may serve as a casing portion of the mobile electronic device so as to be integrated into one with the mobile electronic device. Otherwise, the sound recording module 100 may be assembled to the mobile electronic device by means of external connection. Since the sound recording module 100 may be electrically connected with the mobile electronic device, the sound recorded by the sound recording module 100 can be directly transmitted to the mobile electronic device so as to be played through a speaker of the mobile electronic device. As a result, the sound recording module 100 is not only easy to be carried along by a user, but is also extremely simple to be operated.

Several other embodiments are described below as examples of the invention. It is to be noted that, the following embodiments have adopted component notations and part of the contents from the previous embodiment, wherein the same notations are used for representing the same or similar components, and descriptions of the same technical contents are omitted. The descriptions regarding the omitted part may be referred to the previous embodiment, and thus are not repeated herein.

Figure 2A:
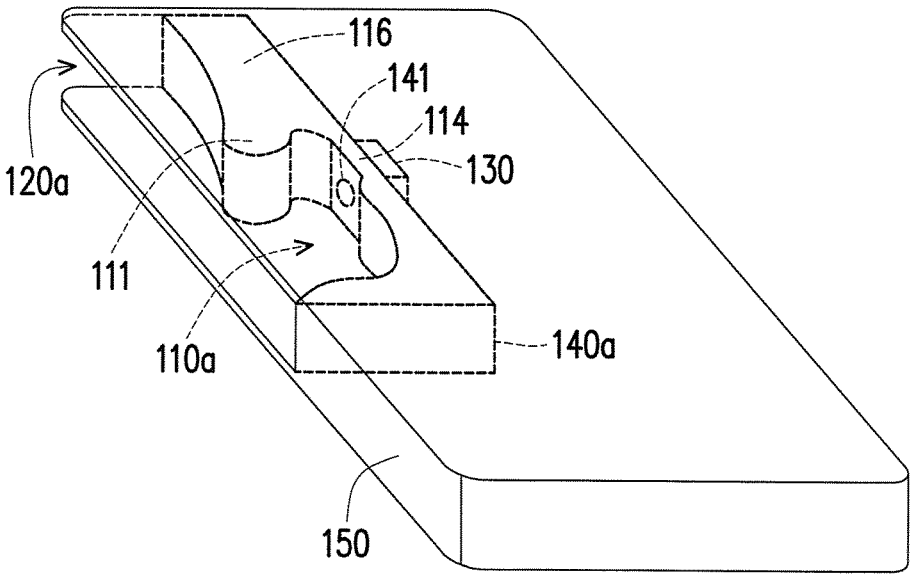
FIG. 2A is a schematic diagram illustrating a sound recording module according to a second embodiment of the invention.
Figure 2B:
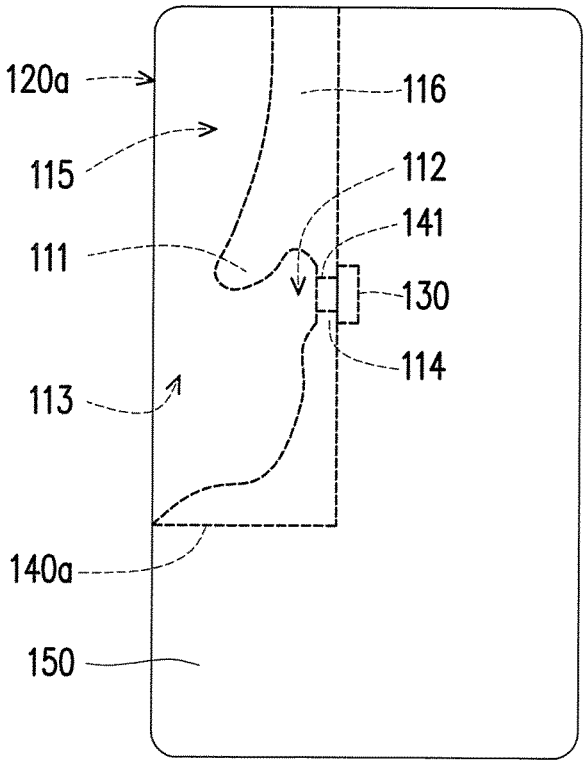
FIG. 2B is a schematic top view illustrating the sound recording module of FIG. 2A.

FIG. 2A is a schematic diagram illustrating a sound recording module according to a second embodiment of the invention. FIG. 2B is a schematic top view illustrating the sound recording module of FIG. 2A. Referring to FIG. 2A and FIG. 2B, a sound recording module 100A of the present embodiment is substantially similar to the sound recording module 100 of the first embodiment, and a difference between the two lies in: a sound-collecting structure 140*a* and the case 150 further defines a first sound wave entering zone 115. The first sound wave entering zone 115 is adjacent to the second sound wave gathering zone 113, wherein the first sound wave entering zone 115 and the second sound wave gathering zone 113 are respectively adjacent to a first sound wave inlet 120*a*, and the first reflecting zone 111 is located between the first sound wave entering zone 115 and the second sound wave gathering zone 113. In detail, the first sound-collecting space 110 and the first sound wave inlet 120*a* are, for example, defined by the sound-collecting structure 140*a* and the case 150, wherein the sound-collecting structure 140*a* and the case 150 further define a first extension zone 116 connected with the first reflecting zone 111, and the first extension zone 116 is adjacent to the first sound wave entering zone 115. For instance, the periphery of the case 150 may have an opening, and the first sound wave inlet 120*a* which belongs a portion of the opening can be defined through the sound-collecting structure 140*a*. As compared to the sound recording module 100 of the first embodiment, an area of the opening of the first sound wave inlet 120*a* of the present embodiment is greater than an area of the opening of the first sound wave inlet 120.

Figure 3A:
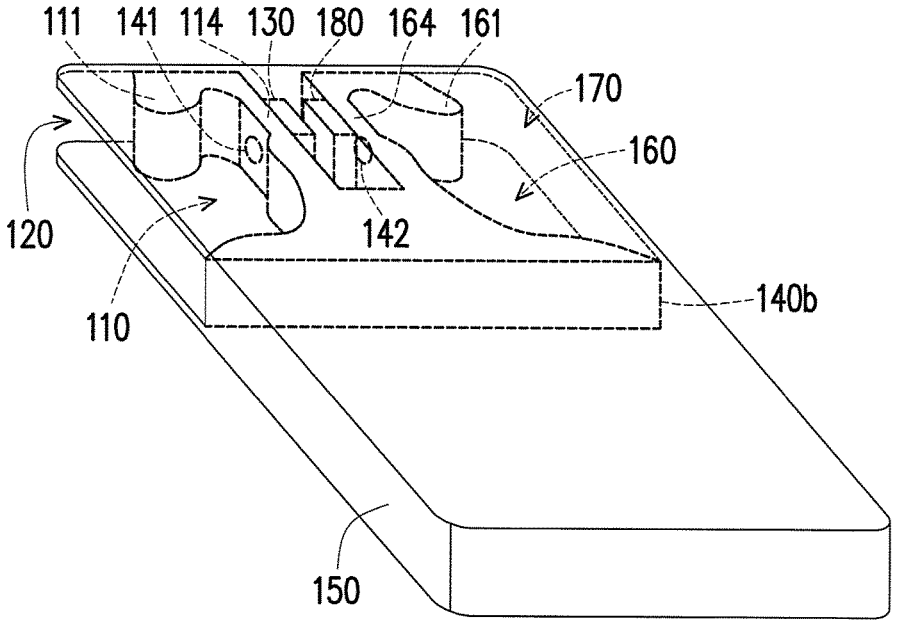
FIG. 3A is a schematic diagram illustrating a sound recording module according to a third embodiment of the invention.
Figure 3B:
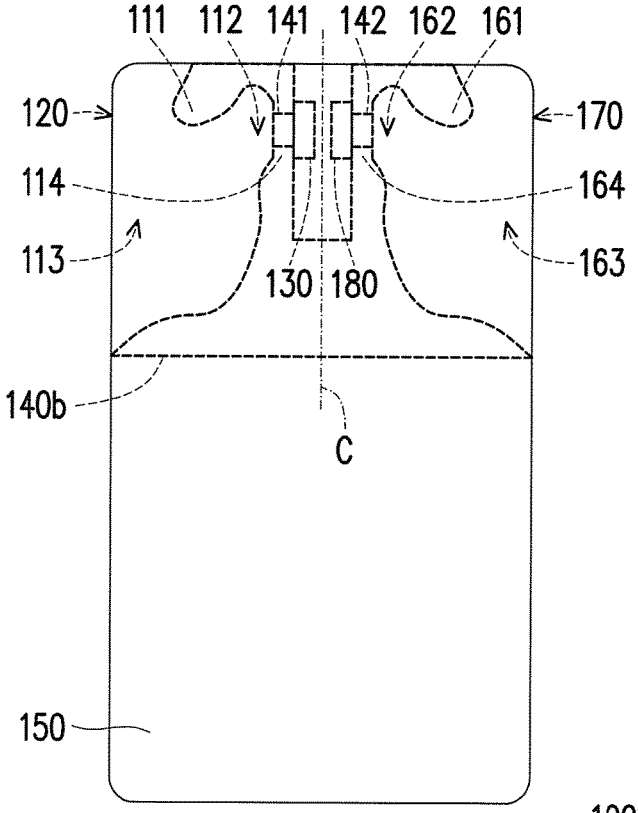
FIG. 3B is a schematic top view illustrating the sound recording module of FIG. 3A.

FIG. 3A is a schematic diagram illustrating a sound recording module according to a third embodiment of the invention. FIG. 3B is a schematic top view illustrating the sound recording module of FIG. 3A. Referring to FIG. 3A and FIG. 3B, a sound recording module 100B of the present embodiment is substantially similar to the sound recording module 100 of the first embodiment, and a difference between the two lies in: the sound recording module 100B can define the first sound-collecting space 110, the first sound wave inlet 120, the second sound-collecting space 160 and the second sound wave inlet 170 through a sound-collecting structure 140*b* and the case 150, wherein the first sound-collecting space 110 and the second sound-collecting space 160 are separated by the sound-collecting structure 140*b* and are not connected with each other. In detail, the sound-collecting structure 140*b* may have a central axis C, the first sound-collecting space 110 and the second sound-collecting space 160 are symmetrically disposed at two opposite sides of the central axis C, and the second sound wave inlet 170 and the first sound wave inlet 120 are symmetrically disposed at the two opposite sides of the central axis C. The first sound wave inlet 120 and the first sound-collecting space 110 are communicated with each other, and the second sound wave inlet 170 and the second sound-collecting space 160 are communicated with each other. Since the sound recording module 100B includes the bilaterally symmetrical first and second sound-collecting spaces 110 and 160, the sound recording module 100B can record sounds coming from two different directions. It is to be particularly noted that, the invention does not limit that the sound recording module must include the bilaterally symmetrical first and second sound-collecting spaces, such that the sound recording module may also only include one of the first sound-collecting space and the second sound-collecting space.

In the present embodiment, the second sound-collecting space 160 and the first sound-collecting space 110 are juxtaposed. The second sound-collecting space 160 at least has a second reflecting zone 161, wherein the second reflecting zone 161 is adjacent to the third sound wave gathering zone 162 and the fourth sound wave gathering zone 163, respectively. The third sound wave gathering zone 163 appears in form of the hand web and defines a second sound-receiving element fixing portion 164 at a deepest position thereof, and the first sound-receiving element fixing portion 114 and the second sound-receiving element fixing portion 164 are opposite to each other. The second sound wave inlet 170 is correspondingly formed on at least part of a periphery of the fourth sound wave gathering zone 163. On the other hand, the sound recording module 100B may include a second sound-receiving element 180, wherein the second sound-receiving element 180 is disposed at the second sound-receiving element fixing portion 164 of the third sound wave gathering zone 162, and the second sound-receiving element 180 and the first sound-receiving element 130 are opposite to each other. The second sound-receiving element 180 is configured to record a sound entering the second sound-collecting space 160.

An aperture of the fourth sound wave gathering zone 163 gradually reduces from the second sound wave inlet 170 towards the third sound wave gathering zone 162, and an aperture of the third sound wave gathering zone 162 gradually reduces from the fourth sound wave gathering zone 163 towards the deepest position (or referred as the second sound-receiving element fixing portion 164) thereof. The deepest position is a place in the third sound wave gathering zone 162 which is farthest away from a connection between the third sound wave gathering zone 162 and the fourth sound wave gathering zone 163. As shown in FIG. 3B, the aperture in the third sound wave gathering zone 162 which is relatively close to the fourth sound wave gathering zone 163 is greater than the aperture in the third sound wave gathering zone 162 which is relatively close to the deepest position (or referred as the second sound-receiving element fixing portion 164), and thus the third sound wave gathering zone 162 appears in form of the hand web. On the other hand, the sound-collecting structure 140*b* may have a second through hole 142, wherein the second through hole 142 passes through the second sound-receiving element fixing portion 164 of the third sound wave gathering zone 162, and the second sound wave inlet 170 and the second through hole 142 are respectively located at two opposite sides of the second sound-collecting space 160.

The second sound-receiving element 180 is, for example, a miniature omnidirectional microphone, which is disposed within the case 150 and accommodated in a trench of the sound-collecting structure 140*b* with the first sound-receiving element 130. In detail, the second sound-receiving element 180 and the third sound wave gathering zone 162 are respectively located at two opposite sides of the second through hole 142. Therefore, a least a portion of the second sound-receiving element 180 fixed on the second sound-receiving element fixing portion 164 of the third sound wave gathering zone 162 can be exposed by the second through hole 142.

Figure 4A:
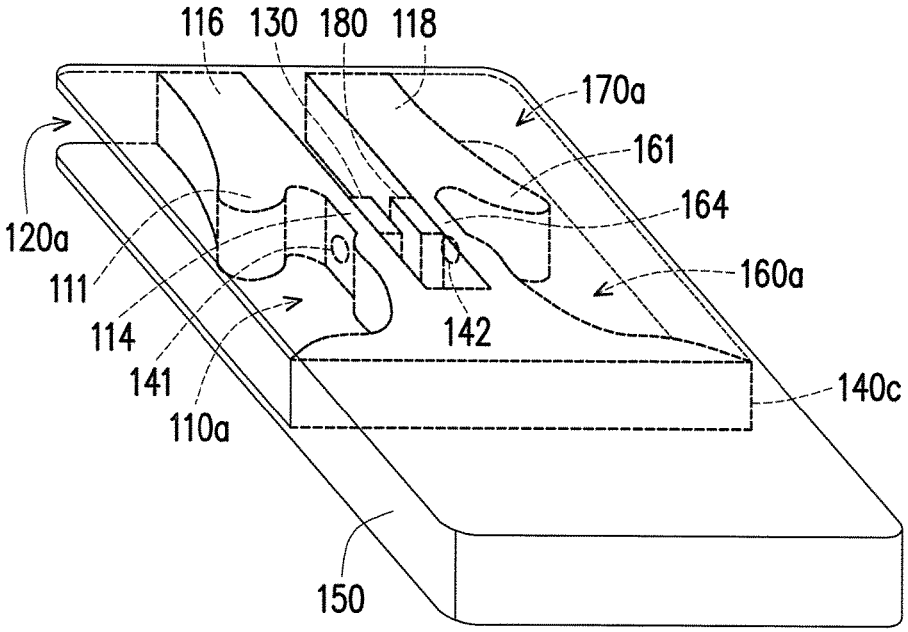
FIG. 4A is a schematic diagram illustrating a sound recording module according to a fourth embodiment of the invention.
Figure 4B:
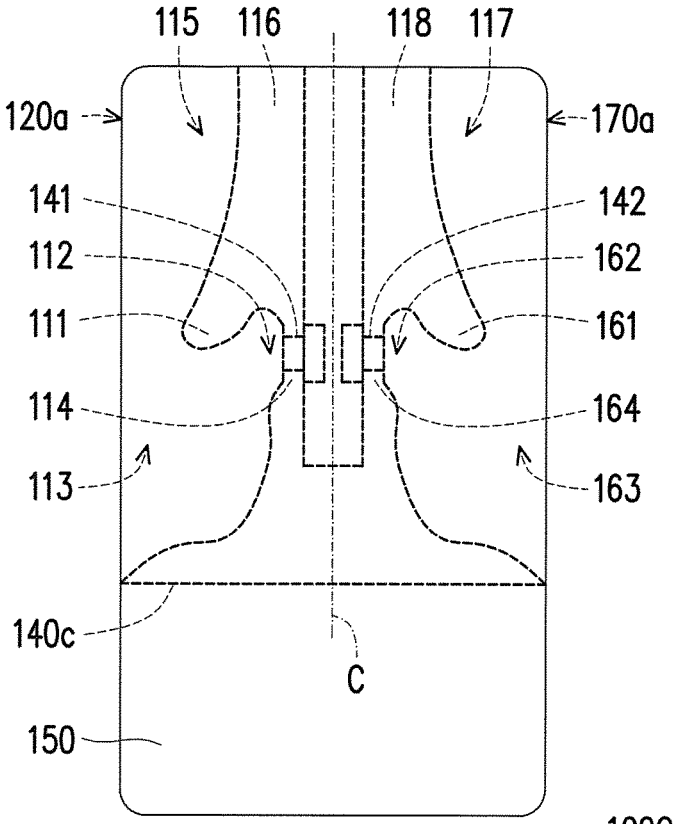
FIG. 4B is a schematic top view illustrating the sound recording module of FIG. 4A.

FIG. 4A is a schematic diagram illustrating a sound recording module according to a fourth embodiment of the invention. FIG. 4B is a schematic top view illustrating the sound recording module of FIG. 4A. Referring to FIG. 4A and FIG. 4B, a sound recording module 100C of the present embodiment is substantially similar to the sound recording module 100B of the third embodiment, a difference between the two lies in: a sound-collecting structure 140*c* and the case 150 further define a first sound wave entering zone 115 and a second sound wave entering zone 117. The first sound wave entering zone 115 is adjacent to the second sound wave gathering zone 113, wherein the first sound wave entering zone 115 and the second sound wave gathering zone 113 are respectively adjacent to the first sound wave inlet 120*a*, and the first reflecting zone 111 is located between the first sound wave entering zone 115 and the second sound wave gathering zone 113. The second sound wave entering zone 117 and the fourth sound wave gathering zone 163 are adjacent to teach other, wherein the second sound wave entering zone 117 and the fourth sound wave gathering zone 163 are respectively adjacent to the second sound wave inlet 170*a*, and the second reflecting zone 161 is located between the second sound wave entering zone 117 and the fourth sound wave gathering zone 163. In detail, the first sound-collecting space 110*a*, the first sound wave inlet 120*a*, the second sound-collecting space 160*a* and the second sound wave inlet 170*a* are, for example, defined by the sound-collecting structure 140*c* and the case 150, wherein the sound-collecting structure 140*c* and the case 150 further define the first extension zone 116 connected with the first reflecting zone 111 and the second extension zone 118 connected with the second reflecting zone 161, the first extension zone 116 is adjacent to the first sound wave entering zone 115, and the second extension zone 118 is adjacent to the second sound wave entering zone 117. It is to be particularly noted that, the invention does not limit that the sound recording module must include the bilaterally symmetrical first and second sound-collecting spaces, such that the sound recording module may also only include one of the first sound-collecting space and the second sound-collecting space.

In summary, because the differences in sound wave transmission distance will result in the sound pressure and phase differences, through utilizing the design of gradually reducing the aperture of the sound-collecting space from the sound wave inlet towards the deepest position (or referred as the sound-receiving element fixing portion) thereof and the design of the reflecting zone, interference of the sound wave entering the sound-collecting space can be controlled, thereby achieving favorable horizontal directivity and noise elimination. As a result, the sound recorded by the sound recording module of the invention, when being played, not only can reproduce the effect of stereo sound but also can provide favorable sound quality.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A sound recording module, comprising:

a sound-collecting space, at least having a reflecting zone, wherein the reflecting zone is adjacent to a first sound wave gathering zone and a second sound wave gathering zone, respectively, and the first sound wave gathering zone appears in form of a hand web and defines a sound-receiving element fixing portion in a deepest position thereof;

a sound wave inlet, correspondingly formed on at least part of a periphery of the second sound wave gathering zone;

a sound-receiving element, disposed at the sound-receiving element fixing portion of the first sound wave gathering zone and configured to record a sound entering the sound-collecting space; and a sound-collecting structure, having a through hole, wherein the through hole passes through the sound-receiving element fixing portion of the first sound wave gathering zone, and the sound wave inlet and the through hole are respectively located at two opposite sides of the sound-collecting space, wherein the sound-receiving element is disposed outside the through hole and the sound-collecting space.

2. The sound recording module as recited in claim 1, further comprising:

a case, wherein the sound-collecting structure is disposed within the case, and the sound-collecting structure and the case define the sound-collecting space and the sound wave inlet.

3. The sound recording module as recited in claim 2, wherein the sound-collecting structure and the case further define a sound wave entering zone, the sound wave entering zone is adjacent to the second sound wave gathering zone, and the reflecting zone is located between the sound wave entering zone and the second sound wave gathering zone.

4. The sound recording module as recited in claim 1, wherein the first sound wave gathering zone and the sound-receiving element are respectively located at two opposite sides of the sound-collecting structure, and the through hole exposes at least a portion of the sound-receiving element.

5. A sound recording module, comprising:

a first sound-collecting space, at least having a first reflecting zone, wherein the first reflecting zone is adjacent to a first sound wave gathering zone and a second sound wave gathering zone, respectively, and the first sound wave gathering zone appears in form of a hand web and defines a first sound-receiving element fixing portion at a deepest position thereof;

a second sound-collecting space, juxtaposed with the first sound-collecting space and at least having a second reflecting zone, wherein the second reflecting zone is adjacent to a third sound wave gathering zone and a fourth sound wave gathering zone, respectively, the third sound wave gathering zone appears in form of the hand web and defines a second sound-receiving element fixing portion at a deepest position thereof, and the first sound-receiving element fixing portion and the second sound-receiving element fixing portion are opposite to each other;

a first sound wave inlet, correspondingly formed on at least part of a periphery of the second sound wave gathering zone;

a second sound wave inlet, correspondingly formed on at least part of a periphery of the fourth sound wave gathering zone, wherein the first sound wave inlet and the second sound wave inlet are opposite to each other;

a first sound-receiving element, disposed at the first sound-receiving element fixing portion of the first sound wave gathering zone and configured to record a sound entering the first sound-collecting space;

a second sound-receiving element, disposed at the second sound-receiving element fixing portion of the third sound wave gathering zone and configured to record a sound entering the second sound-collecting space; and a sound-collecting structure, having a first through hole and a second through hole opposite to the first through hole, wherein the first through hole passes through the first sound-receiving element fixing portion of the first sound wave gathering zone, the first sound wave inlet and the first through hole are respectively located at two opposite sides of the first sound-collecting space, the second through hole passes through the second sound-receiving element fixing portion of the third sound wave gathering zone, and the second sound wave inlet and the second through hole are respectively located at two opposite sides of the second sound-collecting space, wherein the first sound-receiving element is disposed outside the first through hole and the first sound-collecting space, wherein the second sound-receiving element is disposed outside the second through hole and the second sound-collecting space.

6. The sound recording module as recited in claim 5, further comprising:

a case, wherein the sound-collecting structure is disposed within the case, and the sound-collecting structure and the case define the first sound-collecting space, the first sound wave inlet, the second sound-collecting space and the second sound wave inlet.

7. The sound recording module as recited in claim 6, wherein the sound-collecting structure and the case further define a first sound wave entering zone and a second sound wave entering zone, the first sound wave entering zone is adjacent to the second sound wave gathering zone, the first reflecting zone is located between the first sound wave entering zone and the second sound wave gathering zone, the second sound wave entering zone is adjacent to the fourth sound wave gathering zone, and the second reflecting zone is located between the second sound wave entering zone and the fourth sound wave gathering zone.

8. The sound recording module as recited in claim 5, wherein the first sound wave gathering zone and the first sound-receiving element are respectively located at two opposite sides of the sound-collecting structure, the first through hole exposes at least a portion of the first sound-receiving element, the third sound wave gathering zone and the second sound-receiving element are respectively located at the two opposite sides of the sound-collecting structure, and the second through hole exposes at least a portion of the second sound-receiving element.

* * * * *